United States Patent [19]

Ludtka et al.

[11] Patent Number: 4,968,482

[45] Date of Patent: Nov. 6, 1990

[54] URANIUM-TITANIUM-NIOBIUM ALLOY

[75] Inventors: Gail M. Ludtka; Gerard M. Ludtka, both of Oak Ridge, Tenn.

[73] Assignee: The United States of America as represented by the United States Department of Energy, Washington, D.C.

[21] Appl. No.: 483,683

[22] Filed: Feb. 23, 1990

[51] Int. Cl.[5] ..... C22C 43/00

[52] U.S. Cl. ..... 420/3; 148/401; 252/478

[58] Field of Search ..... 420/3; 252/478; 148/401

[56] References Cited

U.S. PATENT DOCUMENTS

| | | | |
|---|---|---|---|
| 4,383,853 | 5/1983 | Zapffe | 420/3 |
| 4,650,518 | 3/1987 | Arntzen et al. | 420/3 |
| 4,701,225 | 10/1987 | Morey | 420/3 |

*Primary Examiner*—Stephen J. Lechert, Jr.
*Attorney, Agent, or Firm*—Katherine P. Lovingood; Stephen D. Hamel; William R. Moser

[57] ABSTRACT

A uranium alloy having small additions of Ti and Nb shows improved strength and ductility in cross section of greater than one inch over prior uranium alloy having only Ti as an alloying element.

4 Claims, No Drawings

URANIUM-TITANIUM-NIOBIUM ALLOY

This invention relates to uranium-titanium-niobium alloys characterized by their high strength and hardenability and was developed by the U.S. Department of Energy under contract number DE-AC05-840R21400.

BACKGROUND OF THE INVENTION

Uranium is significantly strengthened by titanium due to $U_2Ti$ precipitates that harden uranium-titanium (U-Ti) alloys. A typical alloy having a U-0.8Ti composition has a yield strength from 80 to 140 ksi and a ductility ranging from 6 to 20%. To achieve the precipitate formation that is responsible for the hardening it is necessary to rapidly quench from about 800°C. to "freeze" the titanium into solution. Unfortunately, rapid quenching causes structural weaknesses in the alloys at depths of greater than 1 inch. Cross sections larger than 1 inch cool too slowly causing inhomogeneous structures and nonuniform strengths and ductilities, therefore U—Ti alloys have limited application.

Investigators have previously recognized lowering amounts of titanium in U—Ti alloys tends to alleviate the quench rate sensitivity; however, U—Ti alloys also lose strength as titanium concentration decreases. There is, therefore, a continuing need to develop uranium alloys having greater than 1 inch cross sections that are strong and ductile.

SUMMARY OF THE INVENTION

In view of the above needs, it is an object of this invention to provide uranium alloys having greater than 1 inch cross sections that are strong and ductile.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein, the composition of this invention may comprise a uranium base alloy having sufficient Ti and Nb to maximize strength and ductility of the alloy. The preferred composition is from 99.1 to 99.3 wt% uranium, from 0.4 to 0.5 wt% titanium and from 0.1 to 0.3 wt% niobium. These alloys have displayed superior strength and ductility in cross sections greater than one inch when compared with previous U—Ti alloys.

DETAILED DESCRIPTION OF THE PREFERRED EMBODIMENT

Presently, U-0.8Ti is the major uranium alloy used by the U.S. Department of Defense for high strength applications. Lowering the titanium concentration and adding niobium results in an improved alloy with superior hardenability and ductility. The alloy is made by co-melting Derby (or virgin material) uranium, Ti in the form of Ti sponge, and Nb in the form of U-6Nb wt% master alloy, in a vacuum-induction furnace to a temperature of about 1375° C. This is formed into billets and gamma solution heat treated at 800° C for 5 hours and water quenched.

Example I

Two samples of the alloy were prepared from 18 kg of U, 80-95 g of Ti, and 49.0–68.5 g of Nb. The uranium was co-melted with the U–6Nb and Ti sponge in a yttrium coated graphite crucible. The Ti sponge was placed on the bottom of the crucible to ensure adequate mixing with the U and U-6Nb alloy. A Pt/Pt-1ORh thermocouple was used to determine the temperature of the metal in the crucible. The metal was heated to 1375° C, held for 20 minutes and then bottom poured into a yttria coated graphite mold. Both billets were 2.0 inches thick, 5 inches wide and 5 inches long. Both billets were gamma solution heat treated at 800° C for 5 hours and water quenched. Chemical analysis indicted that both billets had a composition in wt% of 99.3 U. 0.4 Ti, 0.3 Nb. Physical tests indicated that the billets had an average tensile yield strength of 106 ksi (±4%), and an average reduction in area (RA) of 33% (±6%). The billet used to obtain hardness data indicated a hardness level of 68 Rockwell A (Ra) at the quenched end and a hardness of 71 Ra at the centerline of 2.0 inch thick casting. Metallographic analyses indicated that the martensite present at a depth of 0.5 inch was 95-100% and at a depth of 1.0 inch was 80–90%. This compares with 10% martensite present at 1.0 inch for the previous alloy, U-0.8Ti.

EXAMPLE II

In a demonstration of the subject development, three billets of the U0.5Ti-0.1Nb ternary alloy were prepared. Two were prepared from 18.5 kg U, 95 g of Ti and 19.6 g of Nb. One billet was prepared from 18.1 kg of U, 93 g of Ti and 19.1 g of Nb. All of these U-Ti-Nb alloy billets were prepared as set forth in Example I. Chemical analysis indicated that the billets had a composition in wt % of 99.3 U, 0.5 Ti, and 0.1 Nb. A 18.5 kg billet was used for Jominy end quench specimens was as cast. Prior to end quenching, the Jominy bar was gamma solution heat treated at 800° C for 2 hours.

Physical test indicated that the tensile billet had an average tensile strength of 108 ksi (±8 ksi), an elongation of 23% (±14%) and a reduction in area of 30% (±6%). The billet to be used for the Jominy hardness determinations had a thickness of 1.5 inches, a width of 5 inches and a length of 7 inches. The Jominy bar was gamma solution heat treated at 800°C. for 2 hours and water quenched from one end. The hardness from the Jominy end quench bar indicated a hardness level of 64.7 Ra at the quenched end and a hardness of 68.7 Ra at 1.0 inch and 66.8 at 2.0 inches. The hardness data from the 2.0 inch thick slab cut from one of the 19.1 kg billets indicated a hardness level of 67 Ra at the quenched end and a hardness of 70 Ra at the centerline of the 2.0 inch thick casting. Metallographic analyses of the Jominy bar indicated that the martensite present at a depth of 0.5 inch was 90–100%, a depth of 1.0 inch was 90–100%, at a depth of 1.5 inch was 40–50% and at a depth of 2.0 inch was 5–10%. Metallographic analyses at the center of the 2.0 inch thick billet indicated that the martensite present at a depth of 0.5 inch from the quenched surface was 90–100% and at a depth of 1.0 inch was 80–90%. In order to determine the approximate content ranges for the alloying elements Ti and Nb, additional experiments were evaluated and are described below. In one experiment two billets were prepared. One billet had a thickness of 2.0 inches, a width of 5 inches and a length of 5.0 inches. The billet was prepared from 18.1 kg of U, 95 g of Ti and 49.2 g of Nb by the procedure described Examples I and II. Chemical analyses indicated that the billet contained, in wt%, 99.2 U, 0.5 Ti and 0.25 Nb. Physical tests indicated that the billet had an average tensile yield strength of 81.4 ksi (±8.4 ksi), with an average elongation of 13.1% (±4.1%) and an average %Ra of 7.4 (±1.7). In the second billet of this experiment, the billet had a thickness of 1.5 inches, a width of 5 inches and a length of 7.0 inches. This billet was prepared from 18.Ikg of U, 95 g of Ti and 49.3 g of Nb by the procedure of the examples. Chemical analyses indicated that the billet contained in wt %, 99.2 U, 0.5 Ti and 0.25 Nb. A Jominy specimen was machined from this billet, gamma solution heat treated at 800° C for 2 hours and end quenched. The hardness measurements from the Jominy end quench bar indicated that the martensite present at a depth of 0.5 inch from the quenched end was 70–90%, at 1.0 inch was 10–25%, at 1.5 inch was 5–10% and at 2 inches was 0–5%. In another experiment, a billet was prepared from 17.7 kg of U, 46.3 g of Ti and 47.8 g of Nb by the procedure of the examples. The billet was 1.5 inches thick, 5 inches wide and 7 inches long. Chemical analyses indicated that the billet contained in wt %, 99.5 U, 0.21 Ti and 0.24 Nb. The hardness measurements from the Jominy end were 59.8Ra at the quenched end, 62.1 Ra at 1 inch and 62.7 at 2 inches. Metallographic analyses indicated martensite present at a depth of 0.5 inch from the quenched end was 10–20%, at 1.0 inch was 5–10%, at 1.5 inch was 0–5% and at 2 inches was 0%.

Although hardness is usually a useful indicator of the relative tensile properties, it does not yield any straight forward information regarding the relative ranking of alloys with respect to their quench rate sensitivity. Therefore, the alloys which indicate the higher depths of larger amounts of martensite yield the best relative quench rate sensitivity.

The data from the chemical analyses, physical tests and metallographic analyses of the billets prepared in the two experiments indicate that the preferred content range of the alloy are in wt % 99.2 to 99.3 U., 0.4 to 0.5 Ti; and 0.1 to 0.3 Nb. The least quench rate sensitive alloys are associated with high Ti and low Nb or low Ti and high Nb combinations.

Unlike steels, in which martensite is aged to temper back, or lower, yield strength and increase ductility, in uranium alloys aging martensite structures results in higher yield strengths and slightly reduced ductility. Therefore aging the claimed alloy will increase the yield strength beyond that attained in the gamma solution heat treated and water quenched (GAMMA/WQ) condition. Since the ductility of the subject alloy is in the range of 25 to 30%, even a 50% reduction in the ductility would not be significant upon aging. In addition, since physical properties are uniform over at least a 2.0 inch thick section in the GAMMA/WQ condition in the subject alloy, the increase in strength due to aging is expected to be uniform. The alloy indicates martensitic microstructure contents of 80 to 100% The homogeneity of this microstructure is what results in the uniformity of the physical properties reported. The U-0.8Ti alloy cannot achieve the homogeneous martensitic structure throughout such thick cross sections since it is approximately twice as quench sensitive as the claimed alloys.

The advantages of these alloys over prior alloys is in their inherent strength. They can be used in the defense industry as well as for radiation shielding, containment vessels for medical and industrial isotopes, and for other applications requiring a uranium alloy having high strength, excellent ductility and hardenability.

We claim:

1. An alloy consisting essentially of uranium and sufficient amounts of titanium to maximize strength by formation of U2Ti precipitates and sufficient amounts of niobium to maximize ductility by improving the martensite homogeneity of said alloy upon quenching.

2. The alloy of claim 1 wherein said alloy has a composition range of 99.1 to 99.3 wt% uranium, from 0.4 to 0.5 wt% titanium and from 0.1 to 0.3 wt% niobium.

3. The alloy of claim 2 wherein said titanium is about 0.4 wt% and said Nb is about 0.3 wt%.

4. The alloy of claim 2 wherein said Ti is about 0.5 wt% and said Nb is about 0.1 wt %.

* * * * *